US010597813B2

(12) United States Patent
Favaro et al.

(10) Patent No.: US 10,597,813 B2
(45) Date of Patent: Mar. 24, 2020

(54) LAUNDRY WASHING MACHINE

(71) Applicant: Electrolux Appliances Aktiebolag, Stockholm (SE)

(72) Inventors: Daniele Favaro, Venice (IT); Maurizio Del Pos, Pordenone (IT)

(73) Assignee: Electrolux Appliances Aktiebolag (SE)

( * ) Notice: Subject to any disclaimer, the term of this patent is extended or adjusted under 35 U.S.C. 154(b) by 0 days.

(21) Appl. No.: 15/528,386

(22) PCT Filed: Nov. 20, 2014

(86) PCT No.: PCT/EP2014/075171
§ 371 (c)(1),
(2) Date: May 19, 2017

(87) PCT Pub. No.: WO2016/078719
PCT Pub. Date: May 26, 2016

(65) Prior Publication Data
US 2017/0321368 A1 Nov. 9, 2017

(51) Int. Cl.
*D06F 39/02* (2006.01)
*D06F 37/22* (2006.01)
(Continued)

(52) U.S. Cl.
CPC ..... *D06F 39/007* (2013.01); *D06F 37/22* (2013.01); *D06F 39/02* (2013.01); *D06F 39/022* (2013.01);
(Continued)

(58) Field of Classification Search
CPC ..... D06F 39/02; D06F 39/022; D06F 39/028; D06F 39/007
See application file for complete search history.

(56) References Cited

U.S. PATENT DOCUMENTS 6,557,382 B1 5/2003 Koike et al.
2014/0157835 A1* 6/2014 Del Pos ..... D06F 39/007 68/17 R
(Continued)

FOREIGN PATENT DOCUMENTS

DE 3520202 A1 12/1986
EP 1085118 A2 3/2001
(Continued)

OTHER PUBLICATIONS

International Search Report dated Dec. 22, 2014 in corresponding International Application No. PCT/EP2014/075171.
(Continued)

*Primary Examiner* — Joseph L. Perrin
(74) *Attorney, Agent, or Firm* — RatnerPrestia

(57) ABSTRACT

A washing machine includes a detergent dispenser to supply detergent into a washing tub, a fresh-water supply circuit selectively channeling fresh water towards the detergent dispenser and/or a washing tub, and an internal water softening device for reducing the hardness degree of the fresh water. The detergent dispenser includes a detergent drawer extractibly fitted/inserted into a substantially basin-shaped housing located/recessed inside an outer casing, and is movable in a substantially horizontal displacement direction (d) between retracted and extracted positions. The detergent drawer includes one or more detergent compartments for filling with detergent, softener or other washing agent, and a regeneration-agent compartment for filling with consumable salt or other regeneration agent. The regeneration-agent compartment is arranged in the detergent drawer beside the detergent compartment/s transversally to the displacement direction (d) inside the housing. Both the detergent compartment/s and the regeneration-agent com-
(Continued)

partment are simultaneously fully accessible in the extracted position.

18 Claims, 8 Drawing Sheets

(51) Int. Cl.
*D06F 39/08* (2006.01)
*D06F 39/00* (2020.01)
*D06F 39/12* (2006.01)

(52) U.S. Cl.
CPC ..... *D06F 39/028* (2013.01); *D06F 39/088* (2013.01); *D06F 39/12* (2013.01)

(56) References Cited

U.S. PATENT DOCUMENTS

| | | | | |
|---|---|---|---|---|
| 2014/0157836 | A1* | 6/2014 | Zattin | D06F 39/007 68/17 R |
| 2014/0165665 | A1* | 6/2014 | Del Pos | D06F 39/007 68/200 |
| 2014/0165666 | A1* | 6/2014 | Del Pos | D06F 39/007 68/200 |
| 2015/0107309 | A1* | 4/2015 | Favaro | D06F 39/007 68/17 R |
| 2015/0107310 | A1* | 4/2015 | Del Pos | D06F 39/028 68/17 R |
| 2015/0204005 | A1* | 7/2015 | Favaro | D06F 39/007 68/17 R |
| 2017/0362763 | A1 | 12/2017 | Favaro et al. | |

FOREIGN PATENT DOCUMENTS

| | | | | |
|---|---|---|---|---|
| EP | 2554736 | A1 | 2/2013 | |
| EP | 2554738 | A1 | 2/2013 | |
| EP | 2562303 | A2 | 2/2013 | |
| EP | 2657389 | A1 | 10/2013 | |
| EP | 2679716 | A1 * | 1/2014 | D06F 39/007 |
| EP | 2733249 | A2 | 5/2014 | |
| WO | 2013045299 | A1 | 4/2013 | |
| WO | 2013098068 | A1 | 7/2013 | |
| WO | 2013160211 | A1 | 10/2013 | |
| WO | 2014121820 | A1 | 8/2014 | |
| WO | 2014121830 | A1 | 8/2014 | |

OTHER PUBLICATIONS

International Search Report dated Mar. 27, 2015 in related International Application No. PCT/EP2014/075178.
International Search Report dated Mar. 23, 2015 in related International Application No. PCT/EP2014/075147.
Notice of Allowance for U.S. Appl. No. 15/528,383, dated Aug. 7, 2019, 8 pages.
Final Office Action for U.S. Appl. No. 15/528,388, dated Sep. 16, 2019, 11 pages.
Non Final Office Action for U.S. Appl. No. 15/528,388, dated May 21, 2019, 26 pages.
Non Final Office Action for U.S. Appl. No. 15/528,383, dated May 28, 2019, 20 pages.
Notice of Allowance for U.S. Appl. No. 15/528,388, dated Nov. 25, 2019, 8 pages.

* cited by examiner

LAUNDRY WASHING MACHINE

BACKGROUND

The present invention relates to a laundry washing machine.

More in particular, the present invention relates to a front-loading home laundry washing machine, to which the following description refers purely by way of example without this implying any loss of generality.

As is known, a front-loading home laundry washing machine generally comprises: a substantially parallelepiped-shaped outer boxlike casing structured for resting on the floor; a substantially horizontally-oriented and approximately cylindrical washing tub which is usually suspended in floating manner inside the casing, with the front mouth directly facing a laundry loading/unloading through opening realized in the front wall of the casing; a substantially cylindrical, cup-shaped rotatable drum structured for housing the laundry to be washed, and which is fitted inside the washing tub with the concavity facing the laundry loading/unloading opening, and is supported by the washing tub in axially rotatable manner so as to be able to freely rotate inside the washing tub about its substantially horizontally-oriented, longitudinal axis; a substantially cylindrical, elastically-deformable bellows which watertight connects the front mouth of the washing tub to the laundry loading/unloading opening formed in the front wall of the casing; a porthole door which is hinged to the front wall of the casing to rotate to and from a closing position in which the door closes the laundry loading/unloading opening in the front wall of the casing for watertight sealing the washing tub; and an electrically-powered motor assembly which is structured for driving into rotation the rotatable drum about its longitudinal axis inside the washing tub.

This type of laundry washing machine furthermore comprises: a detergent dispenser which is located inside the boxlike casing, immediately above the washing tub, and is structured for selectively feeding into the washing tub, according to the washing cycle manually-selected by the user, a given amount of detergent, softener and/or other washing agent suitably mixed with fresh water arriving from the water mains; a fresh-water supply circuit which is structured for selectively drawing fresh water from the water mains according to the washing cycle manually-selected by the user, and channelling said fresh water to the detergent dispenser or directly to the washing tub; and finally an appliance control panel which is generally located on the front wall of the casing, above the laundry loading/unloading opening, and is structured for allowing the user to manually select the desired washing-cycle.

In addition to the above, high-end front-loading laundry washing machines may optionally have an internal water softening device which is located along the fresh-water supply circuit, and is structured to selectively reduce the hardness degree of the tap water channelled towards the detergent dispenser and the washing tub. The use of softened water during the washing cycle, in fact, significantly improves cleaning performances.

More in detail, the water softening device is generally internally provided with a given amount of ion-exchange resins which are capable of restraining the calcium and magnesium ions (Ca++ and Mg++) dissolved in the water flowing through the same water softening device, so as to reduce the hardness degree of the tap water directed towards the detergent dispenser and the washing tub.

In addition to the above, since water softening capabilities of the ion-exchange resins are used to quickly drop off after a limited number of washing cycles, this high-end laundry washing machines are generally provided with an internal salt reservoir which is used to selectively produce some brine (i.e. salt water) which, in turn, is periodically channeled into the water softening device to regenerate the ion-exchange resins located therein. Salt water, in fact, is able to remove from the ion-exchange resins the calcium and magnesium ions previously combined/fixed to said resins.

European patent application No. 1085118 discloses a front-loading home laundry washing machine wherein the salt to be used in the regeneration process of the ion-exchange resins is stowed into a salt compartment located on the back of the detergent drawer of the detergent dispenser.

Unluckily integration of the salt reservoir on the back of the detergent drawer has several drawbacks. First of all, during manual extraction and insertion of the detergent drawer inside the drawer housing, the brine contained into the salt compartment may accidentally come out of the detergent drawer and trickle into the basin-shaped bottom portion of the drawer housing that usually collects the mixture of fresh water and detergent, softener or other washing agent flushed down from the detergent compartments of the detergent drawer, with all problems concerned.

The basin-shaped bottom portion of the drawer housing, in fact, directly communicates with the inside of the washing tub, therefore the brine is allowed to freely flow into the washing tub and cause the quick rusting up of all metal parts of the revolving drum, of the electric heater located on the bottom of the washing tub, and of the drain pump and circulation pump of the laundry washing machine.

Furthermore the arrangement of the salt compartment on the back of the detergent drawer leads to a very complicated structure of the detergent dispenser with the consequent significant increase in the detergent dispenser overall production cost.

SUMMARY OF SELECTED INVENTIVE ASPECTS

An aim of the present invention is to simplify the connection of pump assembly to the regeneration-agent drawer to eliminate the drawbacks referred above.

In compliance with the above aim, according to an aspect of the present invention, there is provided a laundry washing machine comprising an outer casing and, inside said outer casing, a washing tub, a rotatable drum housed in axially rotatable manner inside the washing tub and structured for housing the laundry to be washed, a detergent dispenser which is structured for supplying detergent into the washing tub, a fresh-water supply circuit which is structured for selectively channelling a flow of fresh water from the water mains towards the detergent dispenser and/or the washing tub, and an internal water softening device capable of reducing the hardness degree of the fresh water directed towards the detergent dispenser or the washing tub;

the detergent dispenser in turn comprising a detergent drawer which is fitted/inserted in extractable manner into a corresponding drawer housing which is located/recessed inside the outer casing, and is movable along a displacement direction between a retracted position in which the detergent drawer is almost completely recessed into the outer casing, and an extracted position in which detergent drawer partly juts out from the outer casing; the detergent drawer having one or more detergent compartments each structured for being manually fillable with a given amount of detergent, softener or other washing agent, and a regeneration-agent compartment which is structured for being manually fillable with a given amount of consumable salt or other regeneration agent;

the laundry washing machine being characterized in that the detergent drawer comprises a single drawer-like supporting structure which is fitted/inserted in axially sliding manner into the drawer housing, and in that the detergent compartment/s and the regeneration-agent compartment are arranged on the drawer-like supporting structure transversally to the displacement direction of the detergent drawer inside the drawer housing, so that the detergent compartment/s and the regeneration-agent compartment come out substantially contemporaneously from the outer casing when the detergent drawer moves from the retracted position to the extracted position.

Preferably, though not necessarily, the laundry washing machine is furthermore characterized in that the drawer housing furthermore comprises a substantially vertical, partitioning wall that protrudes upwards from the bottom of the drawer housing substantially parallel to the displacement direction of the detergent drawer, and in that the detergent drawer is arranged astride said partitioning wall so that the one or more detergent compartments and the regeneration-agent compartment are arranged on opposite sides of said partitioning wall.

Preferably, though not necessarily, the laundry washing machine is furthermore characterized in that the drawer-like supporting structure of detergent drawer is coupled in sliding manner to said partitioning wall.

Preferably, though not necessarily, the laundry washing machine is furthermore characterized in that the drawer-like supporting structure of detergent drawer is structured so to abut in axially sliding manner on the upper crest line of said partitioning wall, so as to rest in abutment also onto the partitioning wall.

Preferably, though not necessarily, the laundry washing machine is furthermore characterized in that the upper crest line of the partitioning wall is covered by a longitudinal element or rail which is preferably made of a material having a low friction coefficient and/or self-lubricating properties.

Preferably, though not necessarily, the laundry washing machine is furthermore characterized in that the bottom of the drawer housing is provided with a first and a second separated and substantially basin-shaped bottom portions which are arranged side by side to one another transversally to the displacement direction of the detergent drawer inside the drawer housing; the first basin-shaped bottom portion being vertically aligned, when the detergent drawer is arranged in the retracted position, underneath the one or more detergent compartments of the detergent drawer for collecting the mixture of water and detergent, softener or other washing agent coming out from any one of the detergent compartments of the detergent drawer, and being in communication with the inside of the washing tub; the second basin-shaped bottom portion being vertically aligned, when the detergent drawer is arranged in the retracted position, underneath the regeneration-agent compartment of the same detergent drawer for collecting the brine coming out from the regeneration-agent drawer, and being in communication with the inside of the water softening device.

Preferably, though not necessarily, the laundry washing machine is furthermore characterized in that said two substantially basin-shaped bottom portions of the drawer housing are arranged on opposite sides of said partitioning wall.

Preferably, though not necessarily, the laundry washing machine is furthermore characterized in that the detergent drawer is laterally engaged/coupled in axially sliding manner to the drawer housing via two runners or groves that extend on the sidewalls of the drawer housing substantially parallel to the displacement direction of the detergent drawer.

Preferably, though not necessarily, the laundry washing machine is furthermore characterized in that the drawer-like supporting structure of the detergent drawer is made in a single piece construction, preferably via an injection moulding process.

Preferably, though not necessarily, the laundry washing machine is furthermore characterized in that the detergent drawer comprises a manually-sizable front panel which is arranged/located on a front side of the drawer-like supporting structure, so as to close the entrance of the drawer housing when detergent drawer is placed in the retracted position.

Preferably, though not necessarily, the laundry washing machine is furthermore characterized in that the entrance of the drawer housing is located on a front wall of the outer casing, and in that the manually-sizable front panel of the detergent drawer is arranged locally substantially coplanar to the front face of the casing when the detergent drawer is placed in the retracted position.

Preferably, though not necessarily, the laundry washing machine is furthermore characterized in that the detergent dispenser additionally comprises a drawer flush circuit which is connected to the fresh-water supply circuit, and is structured for pouring, when the detergent drawer is in the retracted position, the fresh water arriving from the water mains selectively and alternatively into any one of the detergent compartments of the detergent drawer so as to selectively flush the detergent, softener or other washing agent out of the same detergent compartment, or into the regeneration-agent compartment of the detergent drawer so as to dissolve some of the salt contained into the regeneration-agent compartment and form some brine.

Preferably, though not necessarily, the laundry washing machine is furthermore characterized in that the drawer flush circuit comprises: a water delivery member which is structured to form the upper lid of the drawer housing, so as to be located above the detergent compartment/s and the regeneration-agent compartment when the detergent drawer is placed in the retracted position, and is provided with a number of water-delivery portions each suitably structured to allow the outflow of the water from the water delivery member towards a respective detergent compartment/s or regeneration-agent compartment of the detergent drawer; and an electrically-operated, flow-diverter which is connected to the water softening device and/or to the fresh-water supply circuit for receiving softened or unsoftened fresh water, and is suitably structured to selectively channel the softened fresh water arriving from the water softening device or the unsoftened fresh water arriving from the fresh-water supply circuit, towards any one of the water-delivery portions of the water delivery member.

Preferably, though not necessarily, the laundry washing machine is furthermore characterized in that the detergent drawer is provided with an upper lid assembly which is arranged on top of the regeneration-agent compartment, and is structured to selectively close/cover the upper mouth of the regeneration-agent compartment for preventing the accidental pouring of detergent, softener or other washing agent into said regeneration-agent compartment.

Preferably, though not necessarily, the laundry washing machine is furthermore characterized in that said upper lid assembly is structured for receiving a flow of fresh water and for channeling said fresh water into the beneath-located regeneration-agent compartment.

Preferably, though not necessarily, the laundry washing machine is furthermore characterized in that said upper lid assembly is provided with a water inlet which is structured to allow the fresh water to enter into the same upper lid assembly, and with one or more water outlets which directly communicate with said the water inlet and are suitably structured to allow the water entering into the upper lid assembly through the water inlet to come out of the lid assembly and fall into the beneath-located regeneration-agent compartment.

Preferably, though not necessarily, the laundry washing machine is furthermore characterized in that the drawer flush circuit is structured to selectively channel the fresh water of the water mains into the upper lid assembly which, in turn, is structured to distribute the fresh water arriving from the drawer flush circuit into the regeneration-agent compartment.

Preferably, though not necessarily, the laundry washing machine is furthermore characterized in that the drawer flush circuit is structured to couple in detachable manner with the water inlet of the upper lid assembly when the detergent drawer is placed in the retracted position.

Preferably, though not necessarily, the laundry washing machine is furthermore characterized in that the upper lid assembly comprises: a plate-like lid element which is structured to rigidly fit to the rim of the regeneration-agent compartment to substantially completely cover/close the upper mouth of the regeneration-agent compartment; and a manually-movable trapdoor which is arranged to close a large pass-through opening that is realized roughly at centre of the plate-like lid element and is suitably shaped/dimensioned to allow the user to easily manually pour the consumable salt or other regeneration agent into the regeneration-agent compartment.

Preferably, though not necessarily, the laundry washing machine is furthermore characterized in that the regeneration-agent compartment of the detergent drawer is furthermore dimensioned to accommodate an amount of consumable salt or other regeneration agent sufficient for performing one or more regeneration processes of the water softening capabilities of the internal water softening device.

Preferably, though not necessarily, the laundry washing machine is furthermore characterized in that the internal water softening device internally contains a given amount of ion-exchange resins capable of restraining the calcium and magnesium ions dissolved in the water that flows through the same water softening device.

BRIEF DESCRIPTION OF THE DRAWINGS

A non-limiting embodiment of the present invention will now be described, by way of example, with reference to the accompanying drawings, in which:

FIG. 11 is a perspective view of the upper lid of the salt compartment of the FIG. 9 detergent drawer; whereas

DETAILED DESCRIPTION OF EXAMPLE EMBODIMENTS

Figure 2:
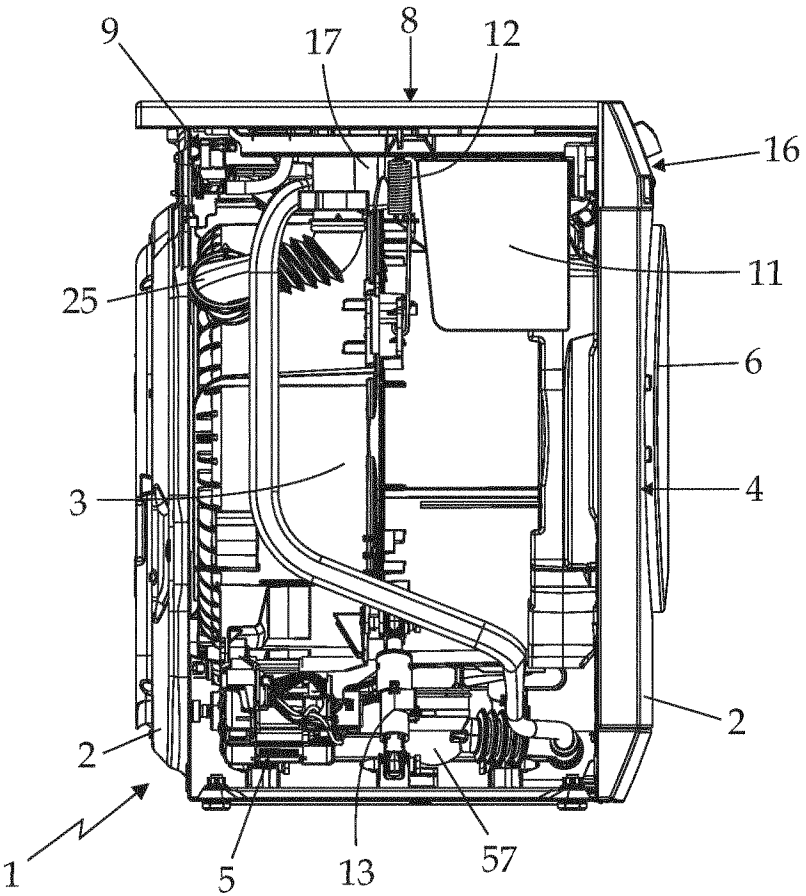
FIG. 2 is a side view of the FIG. 1 laundry washing machine, with parts removed for clarity.
Figure 1:
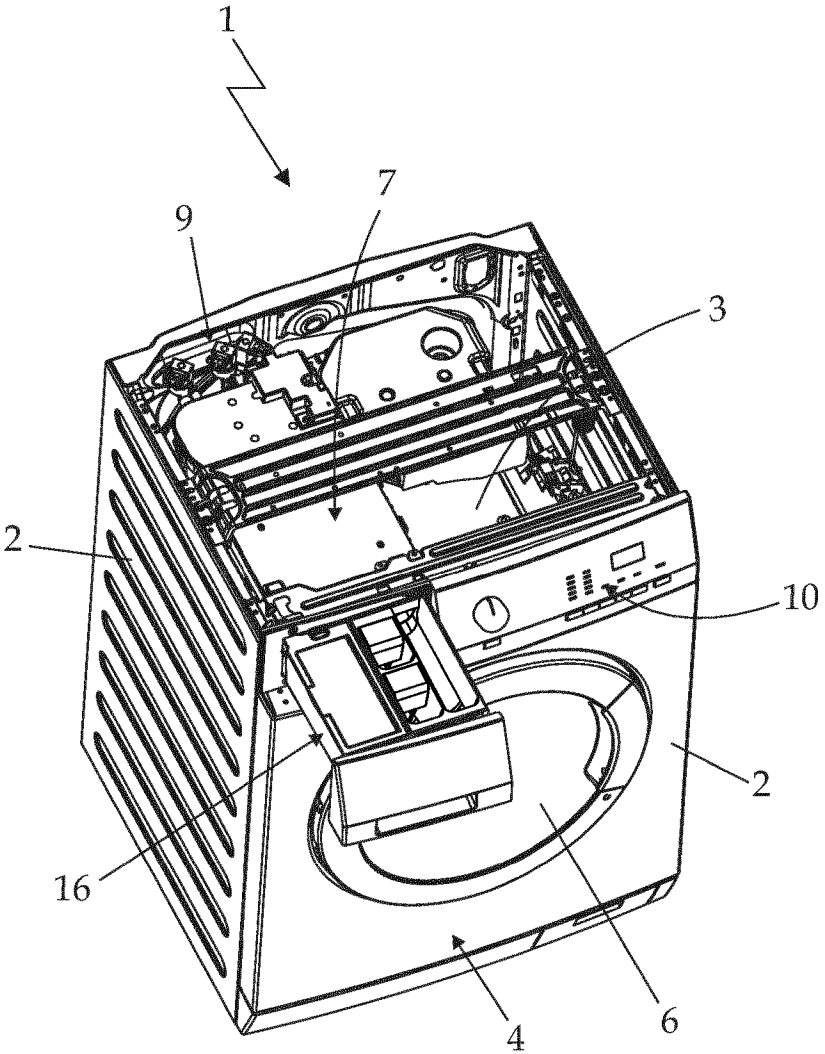
FIG. 1 is a perspective view of a laundry washing machine realized in accordance with the teachings of the present invention, with parts removed for clarity.

With reference to FIGS. 1 and 2, reference number 1 indicates as a whole a laundry washing machine 1 which preferably basically comprises: a preferably substantially parallelepiped-shaped, outer boxlike casing 2 structured for resting on the floor; a preferably substantially horizontally-oriented, approximately cylindrical washing tub 3 which is arranged inside the casing 2 with the mouth directly facing a laundry loading/unloading pass-through opening realized in the front wall 4 of the outer casing 2; a substantially cylindrical, cup-shaped rotatable drum (not shown) which is structured for housing the laundry to be washed, and is fitted in axially rotatable manner inside the washing tub 3 with the concavity facing the front opening or mouth of washing tub 3, so as to be able to freely rotate about its longitudinal axis inside the washing tub 3; an electrically-powered motor assembly 5 which is structured for driving into rotation the rotatable drum (not shown) about its longitudinal axis inside the washing tub 3; and a porthole door 6 which is hinged to the front wall 4 of casing 2 so as to be movable/rotatable to and from a closing position in which the door 6 closes the laundry loading/unloading opening on front wall 4 for watertight sealing the washing tub 4.

Figure 3:
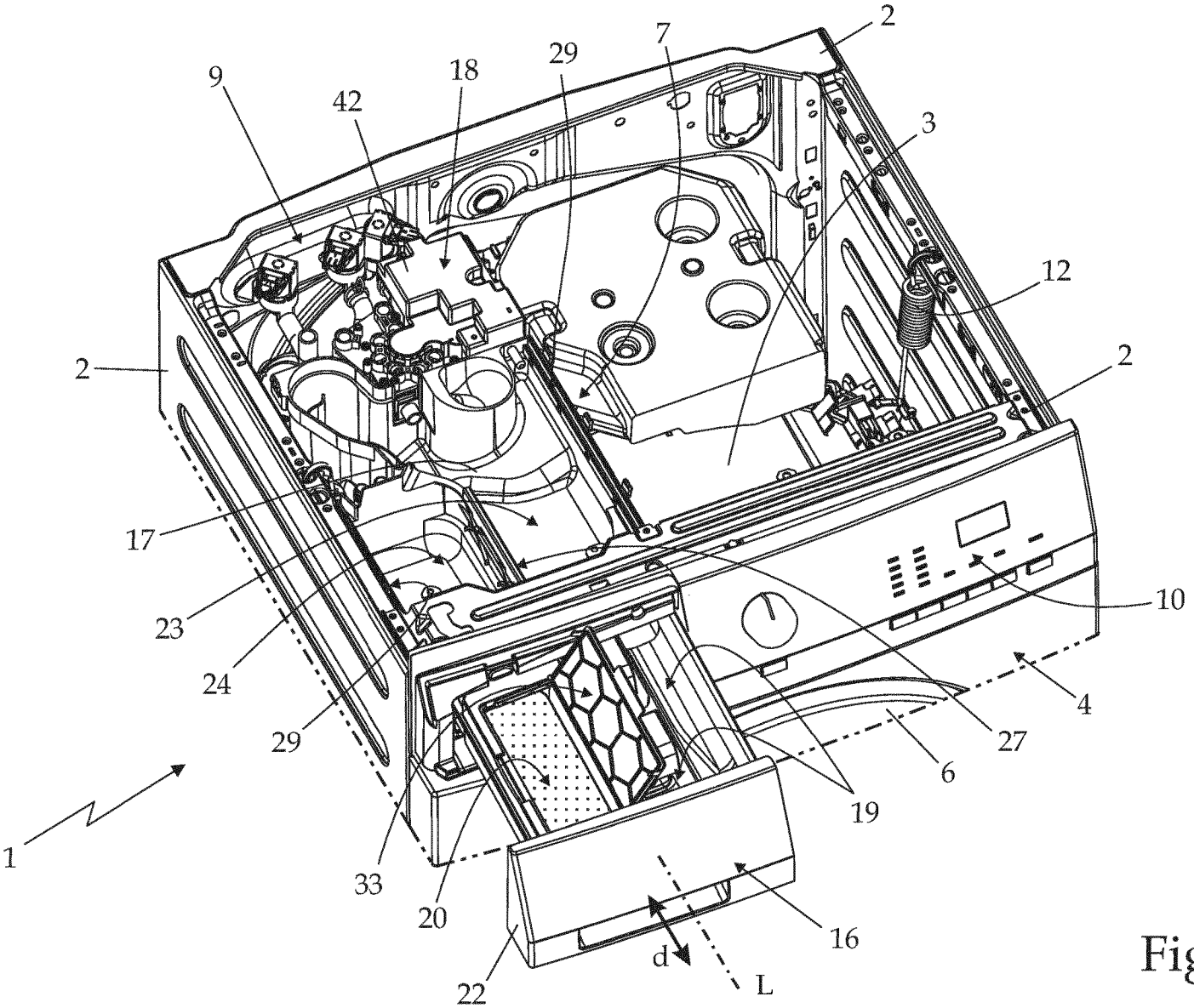
FIG. 3 is an enlarged perspective view of the top of the FIG. 1 laundry washing machine, with parts removed for clarity.

With reference to FIGS. 1, 2 and 3, the laundry washing machine 1 furthermore comprises: a detergent dispenser 7 which is located inside the casing 2 preferably above the washing tub 3 and preferably, though not necessarily, immediately underneath the upper worktop or top wall 8 of casing 2, and is structured for selectively feeding into the washing tub 3, according to the washing cycle manually-selected by the user, a given amount of detergent, softener and/or other washing agent suitably mixed with fresh water; and a fresh-water supply circuit 9 which is connectable directly to the water mains, and is structured for selectively channelling, according to the washing cycle manually-selected by the user, a flow of fresh water from the water mains to the detergent dispenser 7 or directly to the washing tub 3. Preferably laundry washing machine 1 additionally comprises an appliance control panel 10 which is preferably located on the front wall 4 of casing 2, above the laundry loading/unloading opening and preferably also immediately beneath the upper worktop or top wall 8 of casing 2, and is structured to allow the user to manually select the desired washing cycle among a number of available washing cycles.

Figure 4:
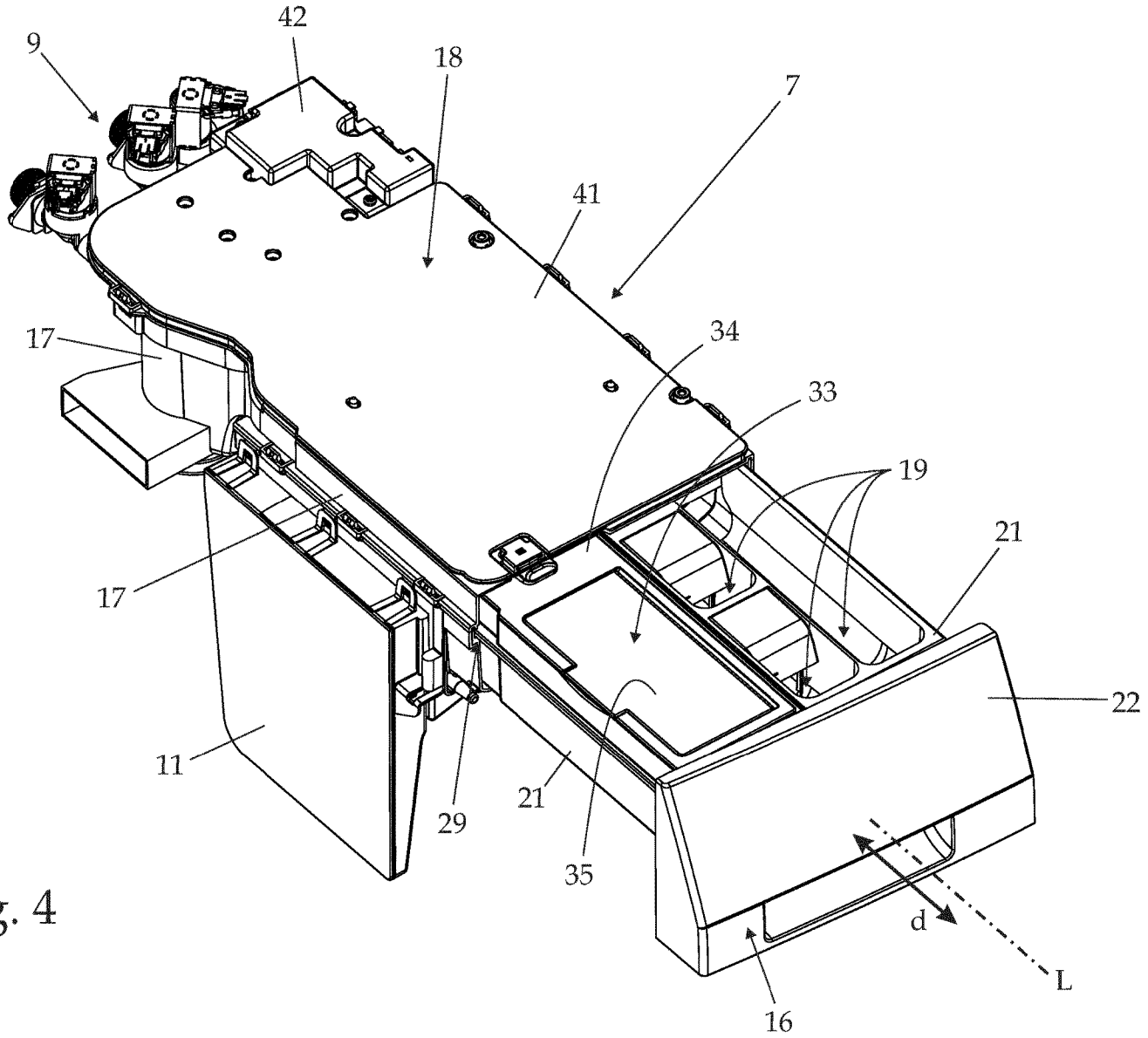
FIGS. 4 and 5 are two perspective views of several inner modules of the FIG. 1 laundry washing machine, assembled to one another and with parts removed for clarity.
Figure 5:
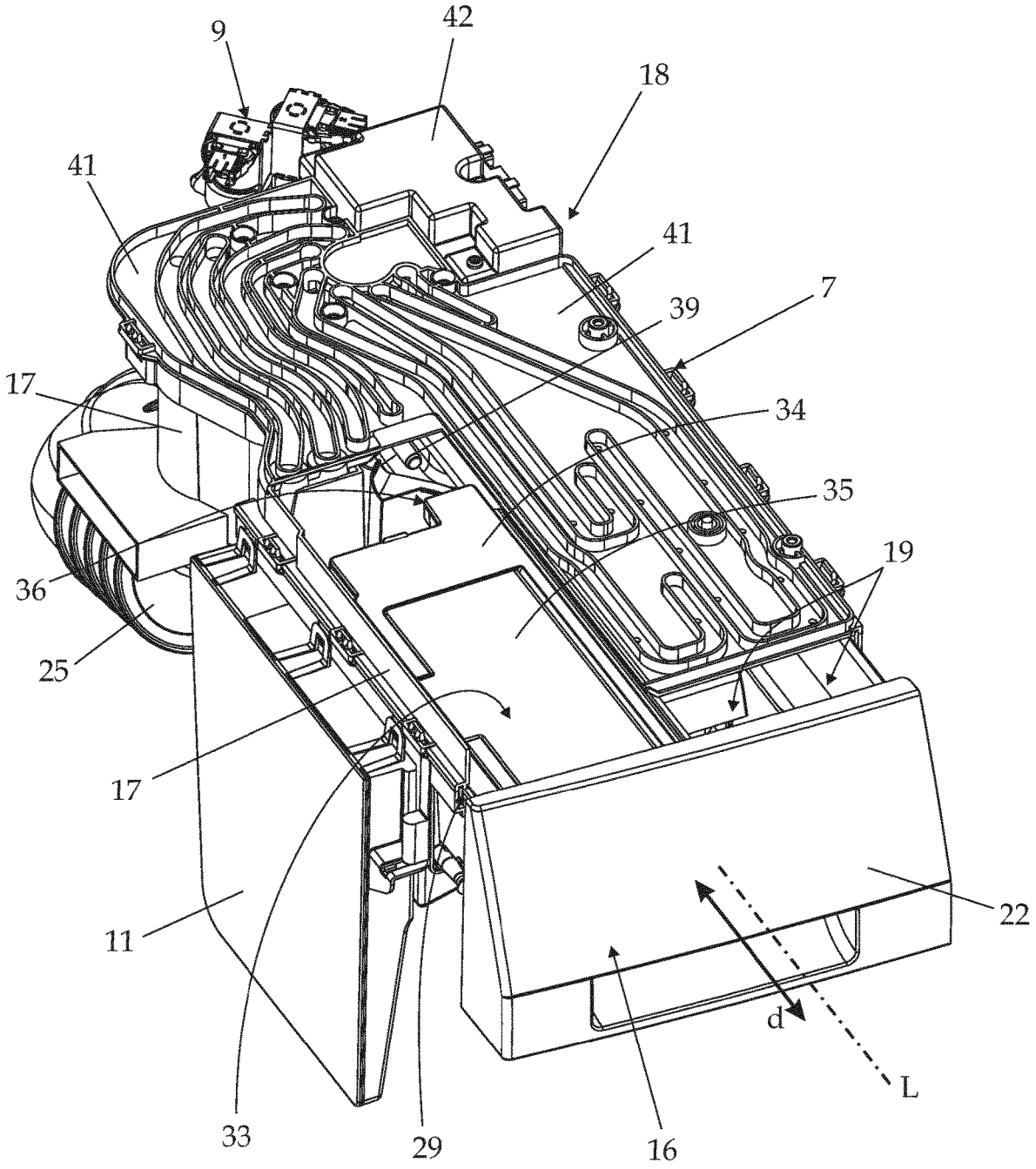

In addition to the above, with reference to FIGS. 2, 4 and 5, the laundry washing machine 1 furthermore comprises an internal water softening device 11 which is located inside the boxlike casing 2, preferably adjacent to the detergent dispenser 7, and is structured for selectively reducing, during each washing cycle, the hardness degree of the tap water that the fresh-water supply circuit 9 channels towards detergent dispenser 7 or washing tub 3.

More in detail, the internal water softening device 11 preferably internally contains a given amount of ion-exchange resins capable of restraining the calcium and magnesium ions (Ca++ and Mg++) dissolved in the water that flows through the same water softening device 11, so as to reduce the hardness degree of the tap water directed towards the washing tub 3.

In the example shown, furthermore, the water softening device 11 is preferably fluidically connected to the detergent dispenser 7 downstream of the fresh-water supply circuit 9, so as to be crossed by the fresh water flowing towards washing tub 3 via detergent dispenser 7.

With reference to FIGS. 1 and 2, in the example shown, in particular, the rotatable drum (not shown) of laundry washing machine 1 is preferably arranged inside the washing tub 3 with the drum rotation axis locally substantially coaxial to the longitudinal axis of washing tub 3, i.e. oriented substantially horizontally, and with the circular front opening or mouth of the drum directly aligned and faced to the circular front opening or mouth of washing tub 3, so as to receive the laundry to be washed through the laundry loading/unloading opening realized on front wall 4.

The washing tub 3, in turn, is preferably suspended in floating manner inside the casing 2 via a suspension system that preferably, though not necessarily, comprises at least one, and preferably a couple of upper coil springs 12 connecting the upper portion of washing tub 3 to the top of casing 2, and preferably at least one, and preferably a couple of vibration dampers 13 connecting the bottom portion of washing tub 3 to the bottom of casing 2. Moreover the laundry washing machine 1 is preferably provided with a substantially cylindrical elastically-deformable bellows (not shown) which watertight connects the front mouth of washing tub 3 to the laundry loading/unloading opening realized on front wall 4 of casing 2.

With reference to FIGS. 1-8, detergent dispenser 7 in turn basically comprises a detergent drawer 16 which is structured for being manually fillable with a given amount of detergent, softener or other washing agent, and is fitted/inserted in manually extractable manner into a corresponding substantially basin-shaped, drawer housing 17 which is located/recessed inside casing 2 above washing tub 3, and whose entrance is preferably located on front wall 4 of casing 2, above the laundry loading/unloading opening realized on the same front wall 4; and preferably a drawer flush circuit 18 which is connected to the fresh-water supply circuit 9, and is structured for selectively pouring, when the detergent drawer 16 is completely fitted/inserted into drawer housing 17, the fresh water arriving from the water mains into the detergent drawer 16, so as to selectively flush the detergent, softener or other washing agent out of detergent drawer 17 and down onto the bottom of drawer housing 17.

More in detail, detergent drawer 16 is provided with one or more substantially basin-shaped, detergent compartments 19 (three detergent compartments 19 in the example shown) each structured for being manually fillable with a given amount of detergent, softener or other washing agent preferably sufficient for performing only a single washing cycle, and is movable inside the drawer housing 17 parallel to the preferably substantially horizontally-oriented, longitudinal axis L of drawer housing 17 between:

- a retracted position (see FIG. 2) in which detergent drawer 16 is completely fitted/inserted into drawer housing 17, so as to be almost completely recessed into the front wall 4 of casing 2; and
- a completely extracted position (see FIGS. 1 and 3) in which detergent drawer 16 partly juts out from the front wall 4 of casing 2, so as to expose the one or more detergent compartments 19.

In other words, detergent drawer 16 is movable inside the drawer housing 17 in a substantially horizontally-oriented, displacement direction d which is locally substantially parallel to the longitudinal axis L of both the drawer housing 17 and the detergent drawer 16, between:

- a retracted position (see FIG. 2) in which detergent drawer 16 is almost completely recessed into the front wall 4 of casing 2 and the one or more detergent compartments 19 of the detergent drawer 16 are inaccessible to the user; and
- a completely extracted position (see FIGS. 1 and 3) in which detergent drawer 16 partly juts out from the front wall 4 of casing 2, so that the one or more detergent compartments 19 of detergent drawer 16 are fully accessible to the user.

Preferably displacement direction d is furthermore locally substantially perpendicular to the front face 4 of casing 2.

In addition to the above, detergent drawer 16 preferably has, inside each detergent compartment 19, a siphon-assembly which is suitably shaped/dimensioned selectively channel the mixture of water and detergent, softener or other washing agent formed inside the detergent compartment 19 on the bottom of drawer housing 17. As an alternative to the siphon-assembly, detergent drawer 16 may have, on the bottom of the detergent compartment 19, a large pass-through opening which is suitably shaped/dimensioned to allow the mixture of water and detergent, softener or other washing agent formed inside the same detergent compartment 19 to freely fall by gravity on the bottom of drawer housing 17.

The drawer flush circuit 18, in turn, is structured for directly pouring, when detergent drawer 16 is placed in the retracted position, a given amount of fresh water of the water mains selectively and alternatively into any one of the detergent compartments 19 of detergent drawer 16, so as to selectively flush the detergent, softener or other washing agent out of the same detergent compartment 19 and down onto the bottom of drawer housing 17.

Preferably, the internal water softening device 11 is furthermore connected to the drawer flush circuit 18 of detergent dispenser 7 so as to be crossed by the fresh water that is subsequently poured into the detergent compartment/s 19 of detergent drawer 16 or directly into the washing tub 3, so that the hardness degree of the fresh water of the water mains poured into any one of the detergent compartments 19 of detergent drawer 16 or into the washing tub 3 is reduced.

With reference to FIGS. 1, 2 and 3, in the example shown, in particular, the entrance of drawer housing 17 is preferably located on front wall 4 of casing 2, immediately underneath the upper worktop or top wall 8 of casing 2, substantially horizontally aligned beside the appliance control panel 10.

The drawer flush circuit 18, in turn, is preferably structured for directly pouring, when detergent drawer 16 is placed in the retracted position, a shower of water droplets selectively and alternatively into any one of the detergent compartments 19 of detergent drawer 16, so as to selectively flush the detergent, softener or other washing agent out of the same detergent compartment 19 and down onto the bottom of drawer housing 17.

With reference to FIGS. 3, 4, 5, 7, 9 and 10, in addition to the above the detergent drawer 16 is moreover provided with a substantially basin-shaped, regeneration-agent compartment 20 which is structured for being manually fillable with a given amount of consumable salt (NaCl) or other regeneration agent suitable to be used in the regeneration process of the ion-exchange resins of the water softening device 11, and which is arranged on the detergent drawer 16 beside the detergent compartment/s 19 transversally to the displacement direction d of detergent drawer 16, i.e. transversally to the longitudinal axis L of detergent drawer 16, so that detergent compartment/s 19 and regeneration-agent compartment 20 come out substantially contemporaneously from the front wall 4 of casing 2 when detergent drawer 16 moves from the retracted position to the extracted position.

In other words, the detergent compartment/s 19 and the regeneration-agent compartment 20 are arranged on opposite sides of a substantially vertically-oriented, reference plane which is parallel to the displacement direction d of detergent drawer 16 inside drawer housing 17, i.e. parallel to the longitudinal axis L of detergent drawer 16.

Preferably regeneration-agent compartment 20 is furthermore dimensioned to accommodate an amount of consumable salt (NaCl) or other regeneration agent sufficient for performing a plurality of regeneration processes of the ion-exchange resins of the water softening device 11.

In view of the above, detergent drawer 16 is movable inside drawer housing 17 in the substantially horizontally-oriented, displacement direction d between:

- a retracted position (see FIG. 2) in which detergent drawer 16 is completely recessed into the front wall 4 of casing 2, so that both the detergent compartment/s 19 and the regeneration-agent compartment 20 are inaccessible to the user; and
- a completely extracted position (see FIGS. 1 and 3) in which detergent drawer 16 partly juts out from the front wall 4 of casing 2, so that both the detergent compartment/s 19 and the regeneration-agent compartment 20 are simultaneously fully accessible to the user.

Figure 10:
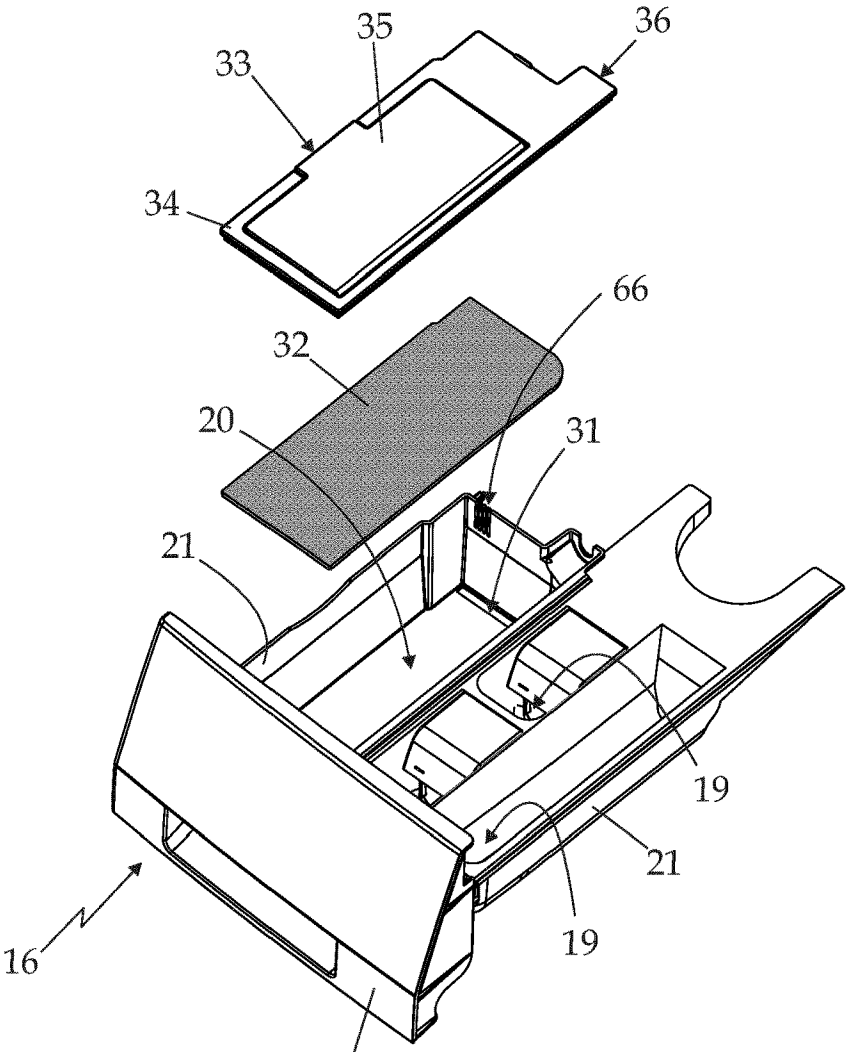
FIG. 10 is a partially exploded perspective view of the FIG. 9 detergent drawer, and with parts removed for clarity.

With reference to FIG. 10, preferably detergent drawer 16 furthermore has, on the bottom of the regeneration-agent compartment 20, a large pass-through opening 31 which is suitably shaped/dimensioned to allow the brine formed inside the regeneration-agent compartment 20 to freely fall by gravity on the bottom of drawer housing 17.

Preferably the detergent drawer 16 moreover has, on a sidewall of the regeneration-agent compartment 20 and at a given high above the bottom of regeneration-agent compartment 20, a small pass-through opening 66 which allows the fresh water or brine to freely overflow onto the bottom of drawer housing 17 when the amount of fresh water or brine inside the regeneration-agent compartment 20 exceeds a given maximum threshold value.

The drawer flush circuit 18 of detergent dispenser 7, in turn, is preferably structured for also selectively pouring, when detergent drawer 16 is placed in the retracted position, a given amount of fresh water of the water mains into the regeneration-agent compartment 20, so as to dissolve some of the salt grains contained into the regeneration-agent compartment 20 and form some brine that falls on the bottom of drawer housing 17.

Figure 9:
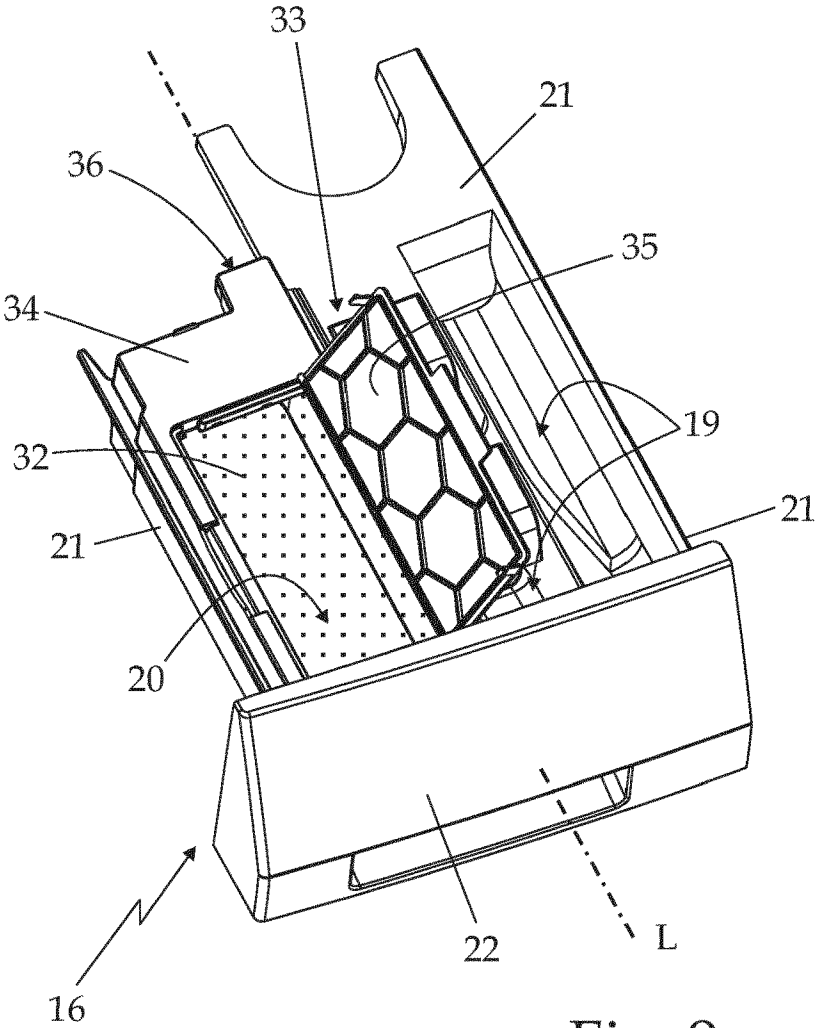
FIG. 9 is a perspective view of the detergent drawer of the FIG. 7 detergent dispenser.

More in detail, with particular reference to FIGS. 4, 9 and 10, detergent drawer 16 comprises: a single drawer-like supporting structure 21 which is preferably made in a one piece construction, and is fitted/inserted in axially sliding manner into the drawer housing 17; and a manually-sizable front panel 22 which is arranged/located on a front side of the drawer-like supporting structure 21, so as to close the entrance of the drawer housing 17 when detergent drawer 16 is placed in the retracted position (see FIG. 2).

In other words, the manually-sizable front panel 22 is arranged/located on the front side of the drawer-like supporting structure 21, so as to be arranged locally substantially coplanar to the front face 4 of casing 2, beside the appliance control panel 10, when detergent drawer 16 is placed in the retracted position (see FIG. 2).

With reference to FIGS. 3 and 4, the detergent compartment/s 19 and the regeneration-agent compartment 20 are therefore directly formed on the drawer-like supporting structure 21 and are arranged on the drawer-like supporting structure 21 transversally to the displacement direction d of detergent drawer 16, i.e. transversally to the longitudinal axis L of detergent drawer 16.

In the example shown, in particular, the drawer-like supporting structure 21 of detergent drawer 16 is preferably made in a single piece, via an injection moulding process. Preferably the same applies to the manually-sizable front panel 22.

The drawer flush circuit 18, in turn, is directly connected to the fresh-water supply circuit 9 for receiving the fresh water of the water mains, and is suitably structured for selectively pouring, when the detergent drawer 16 is completely fitted/inserted into drawer housing 17, the fresh water arriving from the water mains into any one of the detergent or regeneration-agent compartments 19, 20 of detergent drawer 16.

In case of the detergent compartments 19, the poured fresh water serves to selectively flush the contents of the detergent compartment 19 out of the same compartment 19 and down on the bottom of drawer housing 17. In case of the regeneration-agent compartment 20, the poured fresh water serves to dissolve some salt contained into the regeneration-agent compartment 20 to form some brine that falls on the bottom of drawer housing 17.

Figure 6:
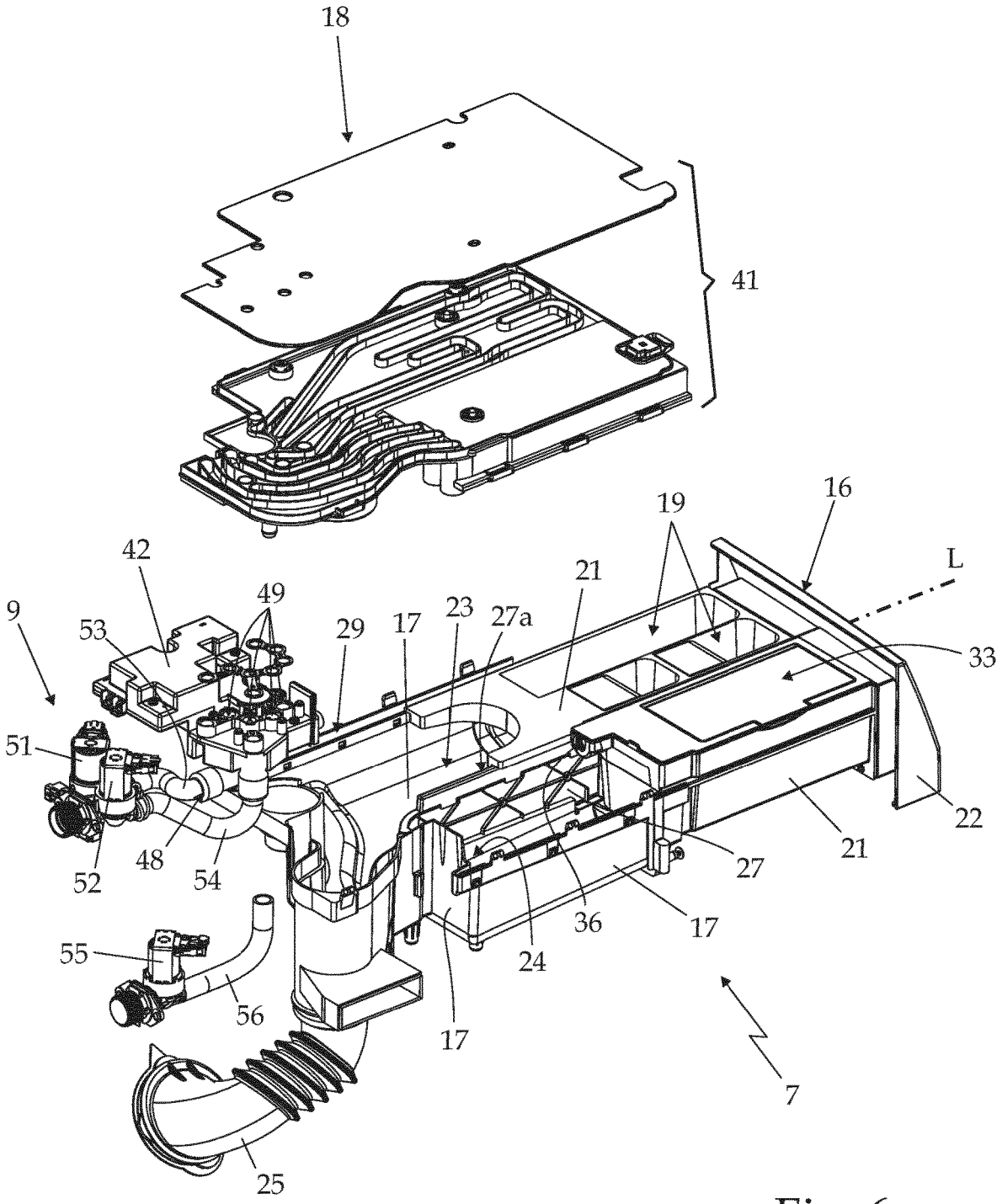
FIG. 6 is a partially exploded perspective view of the FIG. 4 module assembly with parts removed for clarity.
Figure 7:
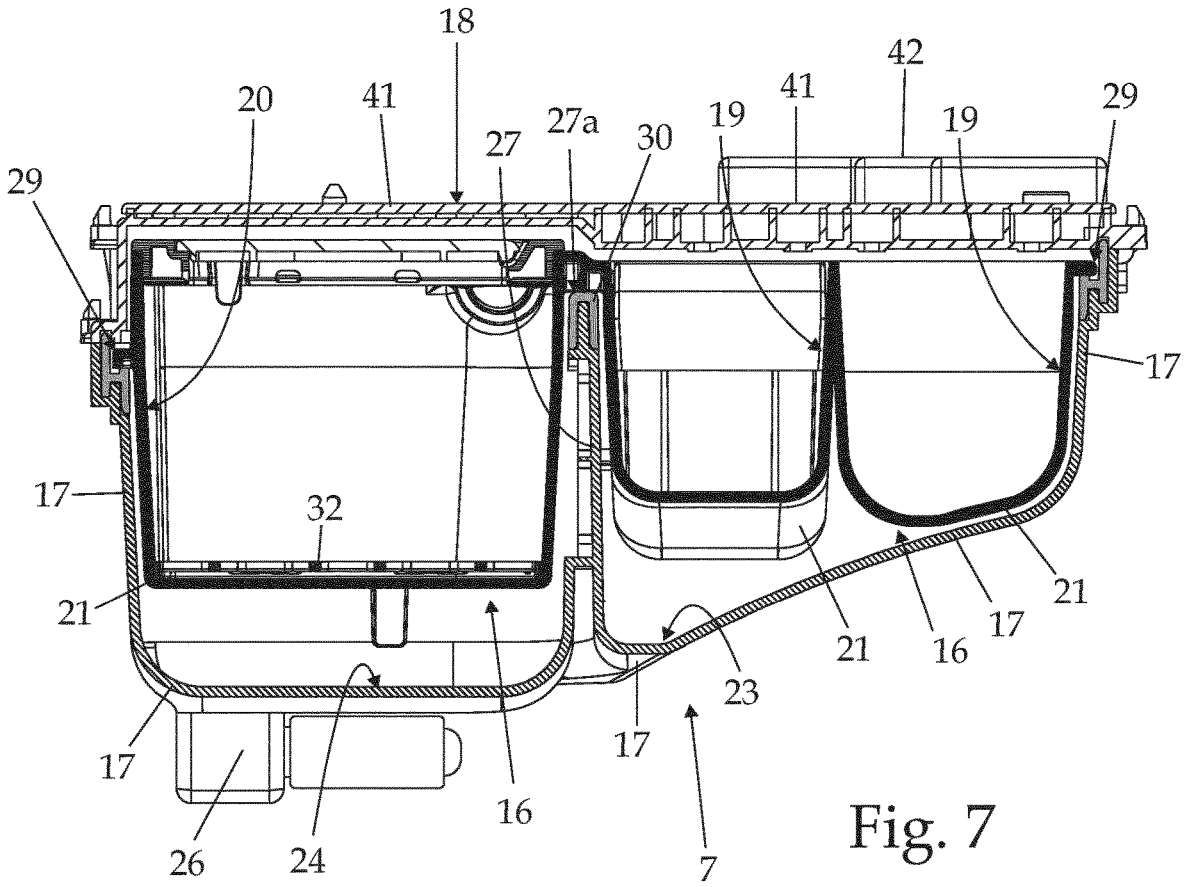
FIG. 7 is a sectioned front view of both the detergent drawer and the drawer housing of the detergent dispenser shown in FIG. 4, with parts removed for clarity.

With reference to FIGS. 3, 6 and 7, the bottom of drawer housing 17 in turn is provided with two separated and substantially basin-shaped bottom portions 23 and 24 which are arranged side by side to one another transversally to the displacement direction d of detergent drawer 16 inside drawer housing 17, i.e. transversally to the longitudinal axis L of drawer housing 17, so as to be vertically aligned, when detergent drawer 16 is placed in the retracted position, one underneath the one or more detergent compartments 19 of detergent drawer 16, and the other underneath the regeneration-agent compartment 20 of detergent drawer 16.

The basin-shaped bottom portion 23 vertically aligned to the detergent compartment/s 19 is structured to collect the mixture of water and detergent, softener or other washing agent coming out from any one of the detergent compartments 19 of detergent drawer 16 preferably through the corresponding siphon-assembly, and preferably communicates with the inside of washing tub 3 via a delivery duct 25 which branches off from the basin-shaped bottom portion 23 of drawer housing 17 and ends directly into the beneath-located washing tub 3, so as to allow the mixture of water and detergent, softener or other washing agent to flow by gravity directly into washing tub 3.

The basin-shaped bottom portion 24 vertically aligned to the regeneration-agent drawer 20, in turn, is structured to collect the brine coming out from the regeneration-agent drawer 20 preferably through the large pass-through opening 31, and is in fluid communication with the inside of the water softening device 11 preferably by means of a small electric pump 26 which is structured to selectively pump the brine (i.e. the mixture of water and salt) from basin-shaped bottom portion 24 to the water softening device 11. In the example shown, in particular, electric pump 26 is preferably an electrically-powered volumetric pump.

Alternatively the brine can freely flow by gravity into the water softening device 11 through a connecting duct that branches off from the basin-shaped bottom portion 24 of drawer housing 17 and ends directly into the water softening device 11. In this case, preferably an automatic one-way valve or an electrically-operated on-off valve may be arranged along said connecting duct to control the outflow of the brine towards the water softening device 11.

With reference to FIGS. 3, 6 and 7, the drawer housing 17 furthermore comprises a substantially vertical, partitioning wall 27 that protrudes upwards from the bottom of drawer housing 17 while remaining locally substantially parallel to the displacement direction d of detergent drawer 16, i.e. parallel to the longitudinal axis L of drawer housing 17, and the substantially basin-shaped bottom portions 23 and 24 are arranged on opposite sides of partitioning wall 27.

In other words the vertical partitioning wall 27 is arranged between the two substantially basin-shaped bottom portions 23 and 24 of drawer housing 17.

The detergent drawer 16, in turn, is arranged astride the partitioning wall 27 so that the one or more detergent compartments 19 and the regeneration-agent compartment 20 are arranged on opposite sides of partitioning wall 27.

More in detail, with reference to FIGS. 6 and 7, the bottom portion of the drawer-like supporting structure 21 of detergent drawer 16 is preferably provided with a rectilinear groove 28 which extends parallel to the longitudinal axis L of detergent drawer 16, i.e. parallel to the displacement direction d of detergent drawer 16 inside drawer housing 17, between the one or more detergent compartments 19 and the regeneration-agent compartment 20, and the partitioning wall 27 of drawer housing 17 protrudes from the bottom of drawer housing 17 and extends upwards into the rectilinear groove 28.

Preferably the drawer-like supporting structure 21 of detergent drawer 16 is furthermore coupled in sliding manner to partitioning wall 27.

More in detail, the drawer-like supporting structure 21 of detergent drawer 16 is preferably structured so to abut in axially sliding manner on the straight upper crest line 27*a* of partitioning wall 27, so that the detergent drawer 16 rests in abutment also onto the same partitioning wall 27.

With reference to FIGS. 3 and 7, in the example shown, in particular, the drawer-like supporting structure 21 of detergent drawer 16 is preferably laterally engaged/coupled in axially sliding manner to drawer housing 17 via two rectilinear runners or groves 29 that extend on the two reciprocally-faced sidewalls of drawer housing 17 locally substantially parallel to the displacement direction d of detergent drawer 16, i.e. parallel to the longitudinal axis L of detergent drawer 16 and drawer housing 17. Furthermore the drawer-like supporting structure 21 of detergent drawer 16 is preferably additionally centrally coupled in axially sliding manner to drawer housing 17 at the upper crest line 27*a* of partitioning wall 27.

Preferably, in the example shown, the upper crest line 27*a* of partitioning wall 27 is furthermore covered by a longitudinal element or rail 30 which is made of a material having a low friction coefficient and/or self-lubricating properties, such as Teflon or similar polymeric materials. Furthermore, in the example shown, the two rectilinear runners or groves 29 and the upper crest line 27*a* of partitioning wall 27 are preferably tilted upwards to the horizontal by an angle $\alpha$ lower that 5°.

With reference to FIG. 10, preferably detergent drawer 16 is moreover provided with a preferably manually-removable, water-permeable partitioning septum 32 which extends inside the regeneration-agent compartment 20 above to the bottom of regeneration-agent compartment 20 and its large pass-through opening 31, and has a water-permeable structure designed for preventing the grains of consumable salt to come out of the regeneration-agent compartment 20 via the pass-through opening 31 and, at same time, for allowing the brine to trickle onto the bottom of the regeneration-agent compartment 20 and then freely flow by gravity towards the pass-through opening 31.

Preferably the partitioning septum 32 furthermore has a water-permeable structure suitably designed to slow down the outflow of the brine from the regeneration-agent compartment 20 via pass-through opening 31 for causing a temporary stagnation of the water poured into the regeneration-agent compartment 20, above the same partitioning septum 32.

In other words, the water-permeable partitioning septum 32 is arranged above the pass-through opening 21 so as to completely cover the latter, and is preferably structured to allow the passage of the water/brine through the same partitioning septum 32 with a flowrate which is lower than that of the fresh water poured into the regeneration-agent compartment 20 by drawer flush circuit 18, thus to cause the stagnation of the fresh water above the partitioning septum 32.

Preferably the water-permeable partitioning septum 32 furthermore extends inside regeneration-agent compartment 20 slightly spaced from, and preferably also locally substantially parallel to, the bottom of regeneration-agent compartment 20, so as to form a thin air gap immediately above the bottom of regeneration-agent compartment 20.

In the example shown, in particular, the water-permeable partitioning septum 32 preferably consists in a rigid panel 32 preferably made of plastic material, which substantially copies the shape of the bottom of regeneration-agent compartment 20, and has a microperforated structure which is suitably dimensioned to cause a prolonged stagnation of the water poured into the regeneration-agent compartment 20 above the partitioning septum 32.

More in detail, the central portion of panel 32 is preferably provided with a plenty of substantially evenly distributed, transversal pass-through microholes or microslots each preferably having a cross-sectional area lower that 3 $mm^2$ (square millimetres), so as to allow the flow/passage of the brine/water through the partitioning septum 32 with a flowrate preferably ranging between 0.4 and 1 litre/min (litre per minute). The flowrate of the fresh water poured into the regeneration-agent compartment 20 instead preferably ranges between 5 and 8 litre/min (litre per minute).

With reference to FIGS. 1, 3, 4, 5, 9 and 10, the detergent drawer 16 is preferably, though not necessarily, additionally provided with an upper lid assembly 33 which is arranged on the drawer-like supporting structure 21, on top of the regeneration-agent compartment 20, and is structured to selectively close/cover the upper mouth of the regeneration-agent compartment 20 for preventing accidental pouring of detergent, softener or other washing agent into the regeneration-agent compartment 20.

Preferably the upper lid assembly 33 is furthermore structured to receive, from drawer flush circuit 18 and when detergent drawer 16 is placed in the retracted position, a flow of fresh water and to channel said fresh water into the beneath-located regeneration-agent compartment 20, preferably while spreading out the same fresh water inside the regeneration-agent compartment 20.

In other words, the upper lid assembly 33 is preferably provided with a water inlet which is faced to the outside of regeneration-agent compartment 20 and is structured to allow the fresh water to enter into the same upper lid assembly 33, and with one or more water outlets which are faced to the inside of regeneration-agent compartment 20, directly communicate with the water inlet and are finally suitably structured to allow the water entering into the upper lid assembly 33 through the water inlet to come out of the lid assembly 33 and fall into the regeneration-agent compartment 20.

Drawer flush circuit 18, in turn, is structured to selectively channel, when detergent drawer 16 is placed in the retracted position, a flow of fresh water of the water mains into the water inlet of lid assembly 33.

The drawer flush circuit 18, therefore, is preferably structured to selectively channel the fresh water of the water mains into the upper lid assembly 33 which, in turn, is structured to channel/distribute the fresh water arriving from the drawer flush circuit 18 into the regeneration-agent compartment 20.

More in detail, the drawer flush circuit 18 is preferably structured to couple in a stable, though easy detachable manner, with the water inlet of lid assembly 33 when the detergent drawer 16 is placed in the retracted position, so as to selectively channel the fresh water of the water mains into the lid assembly 33 which, in turn, is structured to spread out the fresh water into the regeneration-agent compartment 20.

Figure 11:
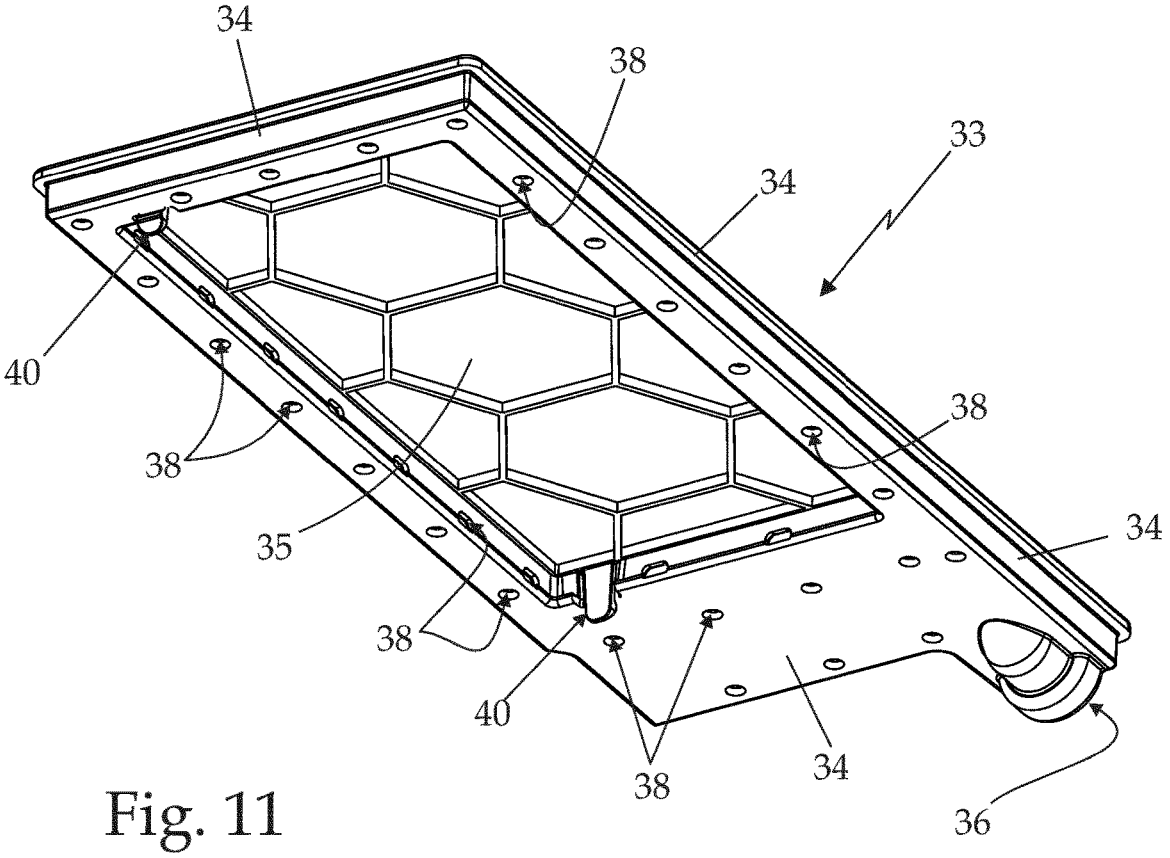

With reference to FIGS. 9, 10, 11 and 10, in the example shown, in particular, the lid assembly 33 preferably comprises a plate-like lid element 34 which is structured to rigidly fit, preferably in easy detachable manner, into the upper rim of regeneration-agent compartment 20 to substantially completely cover/close the upper mouth of regeneration-agent compartment 20; and a manually-movable trapdoor 35 which is arranged to close a preferably substantially rectangular-shaped, large pass-through opening that is realized roughly at centre of the plate-like lid element 34 and is suitably shaped/dimensioned to allow the user to easily manually pour the consumable salt (NaCl) or other regeneration agent into the regeneration-agent compartment 20.

The plate-like lid element 34 is preferably provided with a water inlet 36 which is faced to the outside of regeneration-agent compartment 20 and is suitably structured for receiving the fresh water from the drawer flush circuit 18 when detergent drawer 16 is placed in the retracted position, and with one or more internal water channels 37 each of which begins at water inlet 36 and extends inside the body of the plate-like lid element 34 up to reach a number of water outlets 38 which are arranged on the lower face of the plate-like lid element 34, preferably all around the central pass-through opening closed by trapdoor 35, and are suitably structured to allow the water flowing inside the internal water channel 37 to slowly come out of the plate-like lid element 34 and drip into the regeneration-agent compartment 20.

With reference to FIGS. 5, 9, 10, 11 and 12, in the examples shown, in particular, the plate-like lid element 34 is preferably provided with a first hydraulic connector 36 that protrudes from the back of detergent drawer 16 substantially parallel to the displacement direction d of detergent drawer 16, and is preferably structured to substantially watertight couple in a stable, though easy detachable manner, with a complementary second hydraulic connector 39 which is located stationary inside the drawer housing 17 so as to couple with the hydraulic connector 36 when the detergent drawer 16 is placed in the retracted position, and which communicates with the drawer flush circuit 18 for receiving the fresh water directed to the regeneration-agent compartment 20.

Furthermore in the example shown each water outlet 38 of the plate-like lid element 34 is preferably shaped/structured so as to pour a shower of water droplets by gravity into the regeneration-agent compartment 20.

Figure 12:
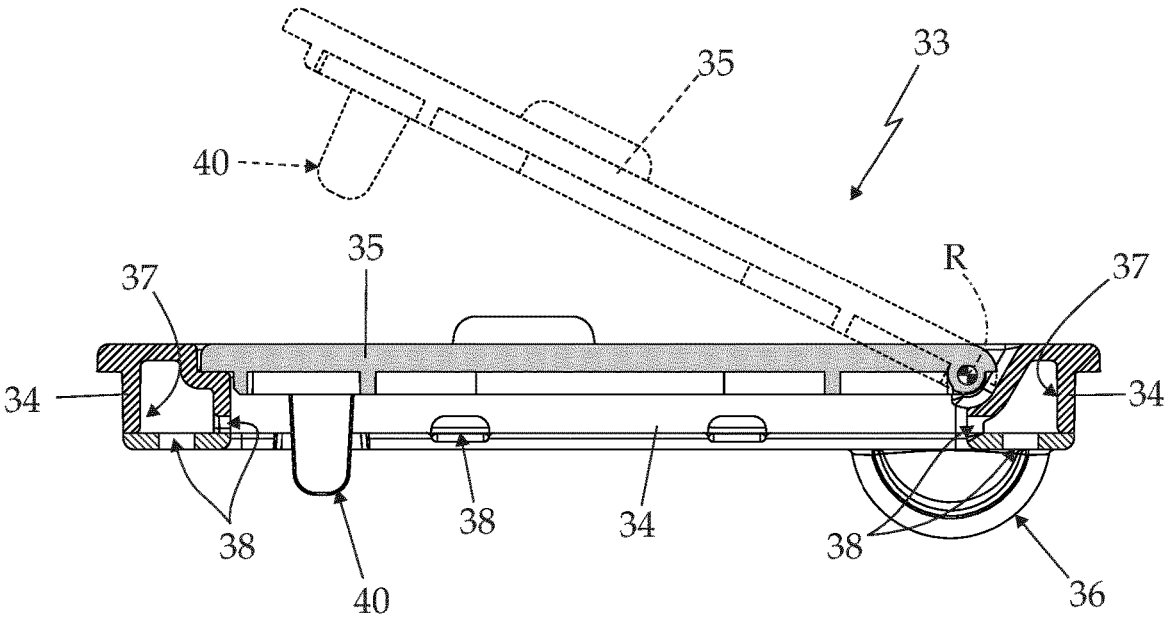
FIG. 12 is a sectioned front view of the FIG. 11 upper lid of the salt compartment with parts removed for clarity.

With particular reference to FIG. 12, the trapdoor 35, in turn, is preferably laterally hinged to the plate-like lid element 34 so as to be able to freely rotate about a reference axis R preferably locally substantially parallel to the longitudinal axis L of detergent drawer 16, i.e. parallel to the displacement direction d of detergent drawer 16, to and from a closing position (see FIG. 12) in which the trapdoor 35 is arranged substantially coplanar to the plate-like lid element 34 and closes the central pass-through opening of the plate-like lid element 34.

With reference to FIGS. 11 and 12, the lid assembly 33 is preferably finally provided with one or more snap-on locking members 40 which are incorporated in the trapdoor 35 and/or in the plate-like lid element 34, and are suitably structured to firmly lock the trapdoor 35 to the plate-like lid element 34 in a stable, tough easy releasable manner, when the trapdoor 35 is arranged in the closing position.

With reference to FIGS. 4, 5, 6, 7 and 8, the drawer flush circuit 18 of detergent dispenser 7, in turn, preferably comprises:

- a plate-like water delivery member 41 which is suitably structured to form the upper lid of the substantially basin-shaped drawer housing 17, so as to be located immediately above the detergent compartment/s 19 and the regeneration-agent compartment 20 when detergent drawer 16 is placed in the retracted position, i.e. when detergent drawer 16 is completely inserted/recessed into drawer housing 17, and is provided with a number of water-delivery portions each suitably structured to allow the outflow of water from the plate-like water delivery member 41 towards a respective compartment 19, 20 of detergent drawer 16; and
- an electrically-operated, flow-diverter 42 which is connected to the water softening device 11 and/or to the fresh-water supply circuit 9 for receiving softened or unsoftened fresh water, and is suitably structured to selectively channel the softened fresh water arriving from the water softening device 11 or the unsoftened fresh water arriving from the fresh-water supply circuit 9, towards any one of the water-delivery portions of the plate-like water delivery member 41.

More in detail, in the example shown the drawer flush circuit 18 of detergent dispenser 7 preferably comprises: a plate-like water delivery member 41 which is suitably structured to form the upper lid of the substantially basin-shaped drawer housing 17 of detergent dispenser 7, so as to be located immediately above the detergent drawer 16 when the latter is placed in the retracted position, i.e. when it is completely inserted/recessed into drawer housing 17; and a discrete, electrically-operated, flow-diverter module 42 which is connected to the water softening device 11 and/or to the fresh-water supply circuit 9, and is fixed/attached outside of the plate-like water delivery member 41, at a coupling socket 43 preferably realized on one of the two major faces of the plate-like water delivery member 41.

Figure 8:
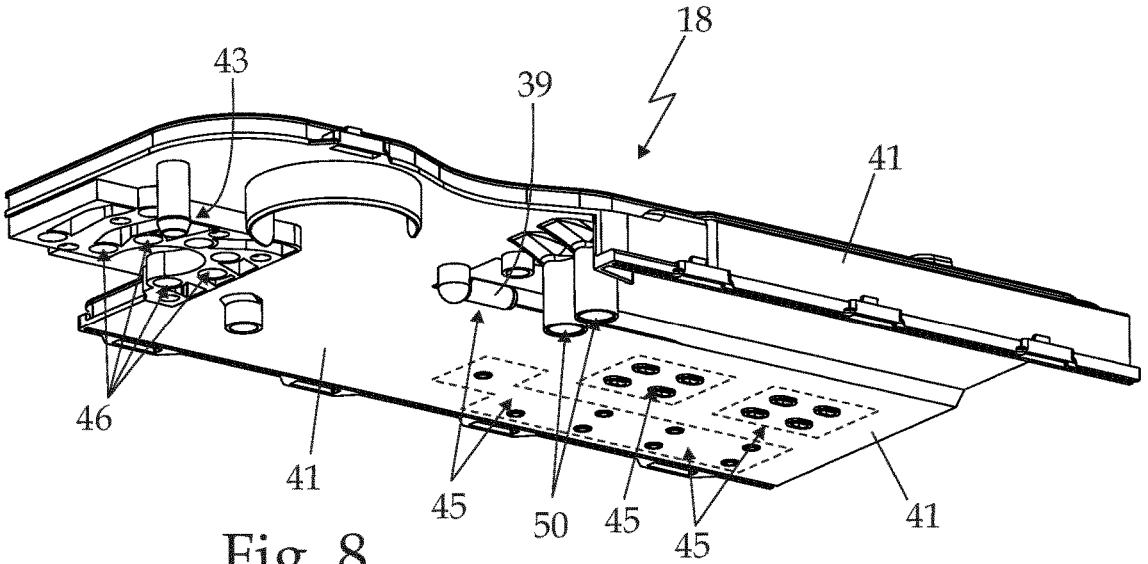
FIG. 8 is a perspective view of the upper lid of the drawer housing of the FIG. 7 detergent dispenser.

With particular reference to FIG. 8, the plate-like water delivery member 41 is provided, on the side directly faced to the inside of drawer housing 17, with a number of water-delivery portions 45 each of which is suitably structured to allow the outflow of the water from the plate-like water delivery member 41, and with a number of water inlets 46 each of which is located at coupling socket 43 and separately communicates with a respective water-delivery portion 45 of the plate-like water delivery member 41.

Some water-delivery portions 45 are preferably arranged on the plate-like water delivery member 41 so as to be locally substantially vertically aligned, when detergent drawer 16 is placed in the retracted position, each to a respective detergent compartment 19 of detergent drawer 16, and are suitably structured to allow the outflow of the fresh water from the plate-like water delivery member 41 towards the beneath-located detergent compartment 19.

Furthermore at least one of the water-delivery portions 45 is arranged on the plate-like water delivery member 41 so as to be locally substantially vertically aligned, when detergent drawer 16 is placed in the retracted position, to the regeneration-agent compartment 20 of detergent drawer 16, and is suitably structured to allow the outflow of the water from the plate-like water delivery member 41 towards the beneath-located regeneration-agent compartment 20.

More in detail, in the example shown the water-delivery portions 45 vertically aligned to the detergent compartments 19 are preferably structured to pour by gravity a shower of water droplets directly into the beneath-located detergent compartment 19 of detergent drawer 16.

The water-delivery portion 45 vertically aligned to the regeneration-agent compartment 20, in turn, is preferably suitably structured to channel, when detergent drawer 16 is placed in the retracted position, the fresh water of the water mains into the water inlet of lid assembly 33, or more precisely into the water inlet 36 of the plate-like lid element 34 that covers/closes the upper mouth of regeneration-agent compartment 20.

In the example shown, in particular, the water-delivery portion 45 vertically aligned to regeneration-agent compartment 20 comprises the hydraulic connector 39 structured to couple with the hydraulic connector 36 of plate-like lid element 34 when detergent drawer 16 is completely fitted/inserted into drawer housing 17, i.e. when detergent drawer 16 is placed in the retracted position.

With reference to FIGS. 4, 5 and 6, the electrically-operated flow-diverter module 42, in turn, is provided with a main water inlet 48 which communicates with the water softening device 11 for receiving softened fresh water, and preferably also directly with the fresh-water supply circuit 9 for also receiving unsoftened fresh water; and with a number of main water outlets 49 which are faced to the coupling socket 43 of plate-like water delivery member 41, and are structured to separately communicate each with a respective water inlet 46 of plate-like water delivery member 41. Furthermore the flow-diverter module 42 is internally structured to selectively channel, towards any one of its water outlets 49, the fresh water entering into the flow-diverter module 42 via the main water inlet 48, so as to be able to selectively channel a flow of softened or unsoftened fresh water into any one of the water inlets 46 of the plate-like water delivery member 41.

More in detail, with reference to FIGS. 4, 5, and 6, in the example shown the plate-like water delivery member 41 is preferably provided with a number of internal water channels each of which separately begins at coupling socket 43, and extends inside the body of plate-like water delivery member 41 up to reach a corresponding water-delivery portion 45 of plate-like water delivery member 41. Each water outlet 49 of flow-diverter module 42 is substantially watertight coupled, at coupling socket 43, with the mouth of a corresponding internal water channel of the plate-like water delivery member 41.

The flow-diverter module 42, in turn, preferably internally accommodates a rotatable flow diverter (not shown) which is capable of channelling, according to its angular position, the water entering into the flow-diverter module 42 via the water inlet 48 towards any one of the water outlets 49 of the flow-diverter module 42.

Preferably the flow-diverter module 42 furthermore comprises an electrically-operated motor assembly (not shown) which is mechanically connected to the rotatable flow diverter for controlling the angular position of the flow diverter, and optionally also an electronic control unit which is structured to directly power and control the electrically-operated motor assembly according to electric signals arriving from the main electronic central control unit (not shown) of the laundry washing machine 1.

In addition to the above, with reference to FIGS. 4, 5 and 8, the internal water softening device 11 is preferably hydraulically connected directly to the plate-like water delivery member 41 of drawer flush circuit 18, so as to be crossed by the fresh water that is subsequently poured into any one of the detergent compartments 19 and optionally also the regeneration-agent compartment 20, so that the hardness degree of the fresh water of the water mains poured into any one of the detergent compartments 19 of detergent drawer 16 is reduced.

More in detail, in the example shown the water softening device 11 is preferably rigidly attached to the drawer casing 7, and is furthermore hydraulically connected directly to the plate-like water delivery member 41 preferably by means of two hydraulic connectors 50 that protrude from the lower face of the plate-like water delivery member 41, i.e. from the major face of plate-like water delivery member 41 provided with the water-delivery portions 45.

The plate-like water delivery member 41 is furthermore provided with an auxiliary water inlet and an auxiliary water outlet that separately communicate each with a respective hydraulic connector 50 via a corresponding internal water channel.

The auxiliary water inlet of plate-like water delivery member 41 is structured to directly couple with the fresh-water supply circuit 9 bypassing the flow-diverter module 42, so as to receive from the fresh-water supply circuit 9 a flow of unsoftened fresh water and channel said unsoftened fresh water towards the water inlet of water softening device 11.

The auxiliary water outlet of plate-like water delivery member 41, in turn, is located at coupling socket 43, and is suitably structured to directly communicated with the main water inlet 48 of flow-diverter module 42, thus to channel a flow of softened fresh water from the water outlet of water softening device 11 to the main water inlet 48 of flow-diverter module 42.

With reference to FIG. 6, the fresh-water supply circuit 9 of laundry washing machine 1, in turn, preferably comprises two independent electrically-operated on-off valves 51 and 52, each of which is separately connectable to the water mains. The electrically-operated on-off valve 51 is directly connected to the main water inlet 48 of flow-diverter module 42 via a first connecting hosepipe or manifold 53. The electrically-operated on-off valve 52 is directly connected to the auxiliary water inlet of plate-like water delivery member 41 via a second connecting hosepipe or manifold 54.

In the example shown, the fresh-water supply circuit 9 preferably finally comprises a further independent electrically-operated, on-off valve 55 which is separately connectable to a source of hot water (namely the hot branch of the piping, fittings, and fixtures involved in the distribution and use of water in the domestic building), and is directly connected to a second auxiliary water inlet of plate-like water delivery member 41 via a third connecting hosepipe or manifold 56.

Preferably this second auxiliary water inlet of plate-like water delivery member 41, in turn, directly communicates with the auxiliary water outlet of plate-like water delivery member 41, thus to channel a flow of hot, unsoftened fresh water towards the main water inlet 48 of flow-diverter module 42. As an alternative, the second auxiliary water inlet of plate-like water delivery member 41 may also directly communicate with the first auxiliary water inlet of plate-like water delivery member 41 thus to channel a flow of hot, unsoftened fresh water towards the water inlet of water softening device 11.

General operation of the laundry washing machine 1 is similar to that of the front loading washing machine disclosed in HITACHI European patent application No. 1085118, thus no other explanations are required.

The advantages resulting from the particular structure of detergent drawer 16 and drawer casing 17 are remarkable.

First of all, the arrangement of detergent compartment/s 19 and regeneration-agent compartment 20 transversally to the displacement direction d of detergent drawer 16, eliminates the risk that some brine or salt (NaCl) may accidentally arrive into the washing tub 3 and cause the quick rusting up of all metal parts of the revolving drum fitted in axially rotatable manner inside washing tub 3, of the electric heater located on the bottom of washing tub 3, and of the drain and circulation pumps that suck the water from the drain sump 57 extending downwards form the bottom of the washing tub 3.

Furthermore the fact that the detergent drawer 16 rests in abutment also on the upper crest line 27*a* of the partitioning wall 27 that protrudes upwards from the bottom of drawer housing 17 while remaining parallel to the displacement direction d of detergent drawer 16, gives to the detergent drawer 16 a greater solidity during insertion and extraction, taking into consideration that the regeneration-agent compartment 20 is preferably structured to accommodate an amount of consumable salt (NaCl) preferably ranging between 0.5 and 2 kg.

Lastly the presence of the lid assembly 33 at closure of regeneration-agent compartment 20 prevents the user from accidentally pouring some detergent, softener or other washing agent into the regeneration-agent compartment 20.

Clearly, changes may be made to the laundry washing machine 1 without, however, departing from the scope of the present invention.

For example, according to a less sophisticated embodiment of drawer flush circuit 18, the electrically-operated, flow-diverter module 42 may be incorporated into the plate-like water delivery member 41 as disclosed in EP2562303.

Furthermore, according to an alternative embodiment, the one or more detergent compartments 19 of detergent drawer 16 may be dimensioned to contain a given amount of detergent, softener or other washing agent sufficient for performing a number of washing cycles. Detergent drawer 16, furthermore, may optionally comprise, for each detergent compartment 19, a respective electrically-powered detergent feeding pump which is structured to selectively suck the dose of detergent, softener or other washing agent necessary to perform a washing cycle from the detergent compartment 19 and pump said dose of detergent, softener or other washing agent on the basin-shaped bottom portion 23 of drawer housing 17.

Lastly, in a not-shown alternative embodiment, the laundry loading/unloading opening is located on the upper worktop or top wall 8 of casing 2, and washing tub 3 is arranged inside the casing 2 with the mouth directly facing the upper worktop or top wall 8. The rotatable drum, in turn, is fitted vertically into washing tub 3 with the concavity facing the upper mouth of washing tub 3, so as to be able to rotate about a substantially vertically-oriented, longitudinal axis.

The invention claimed is:

1. A laundry washing machine comprising an outer casing and, inside said outer casing, a washing tub, a rotatable drum housed in axially rotatable manner inside the washing tub and configured to house the laundry to be washed, a detergent dispenser configured to supply detergent into the washing tub, a fresh-water supply circuit which is structured for selectively channelling a flow of fresh water from water mains towards the detergent dispenser and/or the washing tub, and an internal water softening device configured to reduce a hardness degree of the fresh water directed towards the detergent dispenser or the washing tub;

the detergent dispenser in turn comprising a detergent drawer which is fitted/inserted in an extractable manner into a corresponding drawer housing which is located/recessed inside the outer casing, and is movable along a displacement direction between a retracted position in which the detergent drawer is almost completely recessed into the outer casing, and an extracted position in which the detergent drawer partly juts out from the outer casing; the detergent drawer having one or more detergent compartments each structured for being manually fillable with a given amount of detergent, softener or other washing agent, and a regeneration-agent compartment configured to be manually fillable with a given amount of consumable salt or other regeneration agent;

wherein the detergent drawer of the detergent dispenser comprises:

a single drawer-like supporting structure including the one or more detergent compartments and the regeneration-agent compartment, the detergent drawer being fitted/inserted in an axially sliding manner into the drawer housing, wherein the one or more detergent compartments and the regeneration-agent compartment are arranged in a same single drawer-like supporting structure transversally to the displacement direction of the detergent drawer inside the drawer housing, so that the one or more detergent compartments and the regeneration-agent compartment come out substantially contemporaneously from the outer casing when the detergent drawer moves from the retracted position to the extracted position; and a drawer flush circuit connected to the fresh-water supply circuit, and configured to pour, when the detergent drawer is in the retracted position, the fresh water arriving from the water mains selectively and alternatively into any one of the detergent compartments of the detergent drawer so as to selectively flush the detergent, softener or other washing agent out of a same detergent compartment, or into the regeneration-agent compartment of the detergent drawer so as to dissolve some of the salt contained in the regeneration-agent compartment and form brine, wherein the detergent drawer is provided with an upper lid assembly which is arranged on top of the regeneration-agent compartment, and is configured to selectively close/cover an upper mouth of the regeneration-agent compartment to prevent an accidental pouring of detergent, softener or other washing agent into the regeneration-agent compartment, and wherein the upper lid assembly is configured to receive a flow of fresh water and to channel the fresh water into the regeneration-agent compartment located beneath.

2. The laundry washing machine according to claim 1, wherein the drawer housing comprises a substantially vertical, partitioning wall that protrudes upwards from the bottom of the drawer housing substantially parallel to the displacement direction of the detergent drawer, and in that the detergent drawer is arranged astride said partitioning wall so that the one or more detergent compartments and the regeneration-agent compartment are arranged on opposite sides of said partitioning wall.

3. The laundry washing machine according to claim 2, wherein the drawer-like supporting structure of the detergent drawer is coupled in a sliding manner to said partitioning wall.

4. The laundry washing machine according to claim 2, wherein the drawer-like supporting structure of the detergent drawer is structured so as to abut in an axially sliding manner on an upper crest line of said partitioning wall, so as to rest in abutment also onto the partitioning wall.

5. The laundry washing machine according to claim 4, wherein the upper crest line of the partitioning wall is covered by a longitudinal element or rail which is preferably made of a material having a low friction coefficient and/or self-lubricating properties.

6. The laundry washing machine according to claim 1, wherein the bottom of the drawer housing is provided with a first and a second separated and substantially basin-shaped bottom portions which are arranged side by side to one another transversally to the displacement direction of the detergent drawer inside the drawer housing; the first basin-shaped bottom portion being vertically aligned, when the detergent drawer is arranged in the retracted position, underneath the one or more detergent compartments of the detergent drawer for collecting the mixture of water and detergent, softener or other washing agent coming out from any one of the detergent compartments of the detergent drawer, and being in communication with the inside of the washing tub; the second basin-shaped bottom portion being vertically aligned, when the detergent drawer is arranged in the retracted position, underneath the regeneration-agent compartment of the same detergent drawer for collecting the brine coming out from the regeneration-agent drawer, and being in communication with the inside of the water softening device.

7. The laundry washing machine according to claim 6, wherein said two substantially basin-shaped bottom portions of the drawer housing are arranged on opposite sides of said partitioning wall.

8. The laundry washing machine according to claim 1, wherein the detergent drawer is laterally engaged/coupled in the axially sliding manner to the drawer housing via two runners or groves that extend on the sidewalls of the drawer housing substantially parallel to the displacement direction of the detergent drawer.

9. The laundry washing machine according to claim 1, wherein the drawer-like supporting structure of the detergent drawer is made in a single piece construction.

10. The laundry washing machine according to claim 1, wherein the detergent drawer comprises a manually-sizable front panel which is arranged/located on a front side of the drawer-like supporting structure, so as to close the entrance of the drawer housing when detergent drawer is placed in the retracted position.

11. The laundry washing machine according to claim 10, wherein the entrance of the drawer housing is located on a front wall of the outer casing, and in that the manually-sizable front panel of the detergent drawer is arranged locally substantially coplanar to the front face of the casing when the detergent drawer is placed in the retracted position.

12. The laundry washing machine according to claim 1, wherein the drawer flush circuit comprises: a water delivery member configured to form an upper lid of the drawer housing, so as to be located above the detergent compartment/s and the regeneration-agent compartment when the detergent drawer is placed in the retracted position, and is provided with a number of water-delivery portions each suitably structured to allow an outflow of the water from the water delivery member towards a respective detergent compartment/s or regeneration-agent compartment of the detergent drawer; and an electrically-operated, flow-diverter which is connected to the water softening device and/or to the fresh-water supply circuit for receiving softened or unsoftened fresh water, and is suitably configured to selectively channel the softened fresh water arriving from the water softening device or the unsoftened fresh water arriving from the fresh-water supply circuit, towards any one of the water-delivery portions of the water delivery member.

13. The laundry washing machine according to claim 1, wherein said upper lid assembly is provided with a water inlet which is structured to allow the fresh water to enter into the same upper lid assembly, and with one or more water outlets which directly communicate with said the water inlet and are suitably structured to allow the water entering into the upper lid assembly through the water inlet to come out of the lid assembly and fall into the beneath-located regeneration-agent compartment.

14. The laundry washing machine according to claim 1, wherein the drawer flush circuit is configured to selectively channel the fresh water of the water mains into the upper lid assembly which, in turn, is structured to distribute the fresh water arriving from the drawer flush circuit into the regeneration-agent compartment.

15. The laundry washing machine according to claim 14, wherein the drawer flush circuit is configured to couple in a detachable manner with the water inlet of the upper lid assembly when the detergent drawer is placed in the retracted position.

16. The laundry washing machine according to claim 1, wherein the upper lid assembly comprises: a plate-like lid element configured to rigidly fit to the rim of the regeneration-agent compartment to substantially completely cover/close the upper mouth of the regeneration-agent compartment; and a manually-movable trapdoor which is arranged to close a large pass-through opening that is realized roughly at centre of the plate-like lid element and is suitably shaped/dimensioned to allow the user to easily manually pour the consumable salt or other regeneration agent into the regeneration-agent compartment.

17. The laundry washing machine according to claim 1, wherein the regeneration-agent compartment of the detergent drawer is dimensioned to accommodate an amount of consumable salt or other regeneration agent sufficient for performing one or more regeneration processes of the water softening capabilities of the internal water softening device.

18. The laundry washing machine according to claim 1, wherein the internal water softening device internally contains a given amount of ion-exchange resins capable of restraining calcium and magnesium ions dissolved in the water that flows through the same water softening device.

* * * * *